US009929476B2

(12) United States Patent
Van Swearingen

(10) Patent No.: US 9,929,476 B2
(45) Date of Patent: Mar. 27, 2018

(54) CABLE END PIM BLOCK FOR SOLDERED CONNECTOR AND CABLE INTERCONNECTION

(71) Applicant: CommScope Technologies LLC, Hickory, NC (US)

(72) Inventor: Kendrick Van Swearingen, Woodridge, IL (US)

(73) Assignee: CommScope Technologies LLC, Hickory, NC (US)

( * ) Notice: Subject to any disclaimer, the term of this patent is extended or adjusted under 35 U.S.C. 154(b) by 140 days.

(21) Appl. No.: 15/146,438

(22) Filed: May 4, 2016

(65) Prior Publication Data

US 2016/0329643 A1 Nov. 10, 2016

Related U.S. Application Data

(60) Provisional application No. 62/158,374, filed on May 7, 2015.

(51) Int. Cl.

| | |
|---|---|
| ***H01R 9/05*** | (2006.01) |
| ***H01R 4/02*** | (2006.01) |
| ***H01R 13/52*** | (2006.01) |
| ***H01R 24/56*** | (2011.01) |
| *H01R 43/02* | (2006.01) |

(52) U.S. Cl.

CPC ..... *H01R 4/02* (2013.01); *H01R 13/5205* (2013.01); *H01R 24/564* (2013.01); *H01R 43/02* (2013.01)

(58) Field of Classification Search

CPC ..... H01R 4/024; H01R 24/564

USPC ..... 439/578, 874

See application file for complete search history.

(56) References Cited

U.S. PATENT DOCUMENTS

| | | | | |
|---|---|---|---|---|
| 5,281,167 | A * | 1/1994 | Le | H01R 43/0242 439/578 |
| 5,561,900 | A * | 10/1996 | Hosier, Sr. | H01R 24/542 174/75 C |
| 5,802,710 | A * | 9/1998 | Bufanda | H01R 9/05 29/828 |
| 6,439,924 | B1 * | 8/2002 | Kooiman | H01R 4/023 439/578 |
| 6,471,545 | B1 * | 10/2002 | Hosier, Sr. | H01R 24/542 439/205 |
| 6,716,061 | B2 * | 4/2004 | Pitschi | H01R 24/564 333/260 |
| 6,939,169 | B2 * | 9/2005 | Islam | H01R 9/0521 439/578 |
| 7,637,774 | B1 * | 12/2009 | Vaccaro | H01R 9/0521 29/828 |
| 7,900,344 | B2 | 3/2011 | Ng et al. | |
| 8,047,870 | B2 * | 11/2011 | Clausen | H01R 9/0524 439/578 |

(Continued)

*Primary Examiner* — Neil Abrams

(74) *Attorney, Agent, or Firm* — Myers Bigel, P.A.

(57) ABSTRACT

A cable-connector assembly includes: a coaxial connector having an outer connector body with a solder bore; a coaxial cable having an inner conductor and an outer conductor, the outer conductor seated within the solder bore; and a PIM block comprising an annular seat and a generally cylindrical flange extending from an outer periphery of the annular seat along a longitudinal axis of the annular seat. A leading edge of the outer conductor of the cable is inserted within the flange of the PIM block. An outer diameter of the outer conductor is coupled to an inner diameter of the solder bore via a solder joint.

18 Claims, 6 Drawing Sheets

(56) References Cited

U.S. PATENT DOCUMENTS

| | | | | |
|---|---|---|---|---|
| 8,517,754 | B2 * | 8/2013 | Shaw | H01R 9/0524 439/275 |
| 8,984,745 | B2 | 3/2015 | Paynter et al. | |
| 9,166,306 | B2 * | 10/2015 | Montena | H01R 9/0524 |
| 9,515,444 | B2 * | 12/2016 | Van Swearingen | B23K 35/362 |
| 9,647,353 | B2 * | 5/2017 | Paynter | H01R 9/05 |
| 9,748,711 | B2 * | 8/2017 | Zimmerhaeckel | H01R 24/545 |
| 9,768,522 | B2 * | 9/2017 | Harwath | H01R 4/024 |
| 2016/0329643 | A1 * | 11/2016 | Van Swearingen | H01R 4/02 |

* cited by examiner

{Prior Art}

{Prior Art}

{Prior Art}

{Prior Art}

CABLE END PIM BLOCK FOR SOLDERED CONNECTOR AND CABLE INTERCONNECTION

RELATED APPLICATION

The present application claims priority from and the benefit of U.S. Provisional Patent Application No. 62/158,374, filed May 7, 2015, the disclosure of which is hereby incorporated herein in its entirety.

FIELD OF THE INVENTION

The invention relates generally to a connector and cable interconnection. More specifically, the invention relates to a soldered connector and cable interconnection.

BACKGROUND

U.S. Pat. No. 5,802,710 discloses an electrical connector for use with coaxial cable and a method for attaching same. The connector may be attached to the coaxial cable with a high level of quality control via an assembly apparatus, as disclosed in commonly owned U.S. Pat. No. 7,900,344. The connector utilizes an insulating disc retained upon the inner connector and against the dielectric layer and outer conductor of the cable. Induction heating of a solder preform wrapped around the outer conductor creates a molten solder pool in a cylindrical solder cavity formed between the outer conductor, the insulating disc and the outer body of the connector. The insulating disc prevents the molten solder from migrating out of the cavity, which could foul the connector bore and/or short the outer and inner conductors. U.S. Pat. No. 8,984,745 discloses a variation of U.S. Pat. No. 7,900,344, supra, wherein a close-fitting interface pedestal provides the sidewall of the solder cavity in the solder apparatus, enabling elimination of the insulating disc.

Passive Intermodulation Distortion (PIM) is a form of electrical interference/signal transmission degradation that may occur with non-symmetrical interconnections and/or as electro-mechanical interconnections shift or degrade over time (for example, due to mechanical stress, vibration, thermal cycling, corrosion and/or material degradation). PIM is an important interconnection quality characteristic, as PIM generated by a single low quality interconnection may degrade the electrical performance of an entire RF system.

Competition within the cable and connector assembly industry has increased the importance of improving the electro-mechanical characteristics of the cable and connector interconnection while easing requirements for proper assembly.

SUMMARY

As a first aspect, embodiments of the invention are directed to a cable-connector assembly, comprising: a coaxial connector having an outer connector body with a solder bore; a coaxial cable having an inner conductor and an outer conductor, the outer conductor seated within the solder bore; and a PIM block comprising an annular seat and a generally cylindrical flange extending from an outer periphery of the annular seat along a longitudinal axis of the annular seat. A leading edge of the outer conductor of the cable is inserted within the flange of the PIM block. An outer diameter of the outer conductor is coupled to an inner diameter of the solder bore via a solder joint.

As a second aspect, embodiments of the invention are directed to a method for interconnecting a connector and a coaxial cable with an outer conductor; comprising: providing a coaxial cable having an inner conductor and an outer conductor, the outer conductor having a leading edge; providing a connector having an outer body with a solder bore; providing a PIM block having a generally annular ring and a generally cylindrical flange; seating the leading edge of the outer conductor within the cylindrical flange; inserting the PIM block and coaxial cable into the solder bore of the connector; and soldering an outer diameter of the outer conductor to an inner diameter of the solder bore.

As a third aspect, embodiments of the invention are directed to a table-connector assembly, comprising: a coaxial connector having an outer connector body with a solder bore; a coaxial cable having an inner conductor and an outer conductor, the outer conductor seated within the solder bore; and a PIM block comprising an annular seat and a generally cylindrical flange extending from an outer periphery of the annular seat along a longitudinal axis of the annular seat. A leading edge of the outer conductor of the cable is inserted within the flange of the PIM block and seated against the annular seat.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
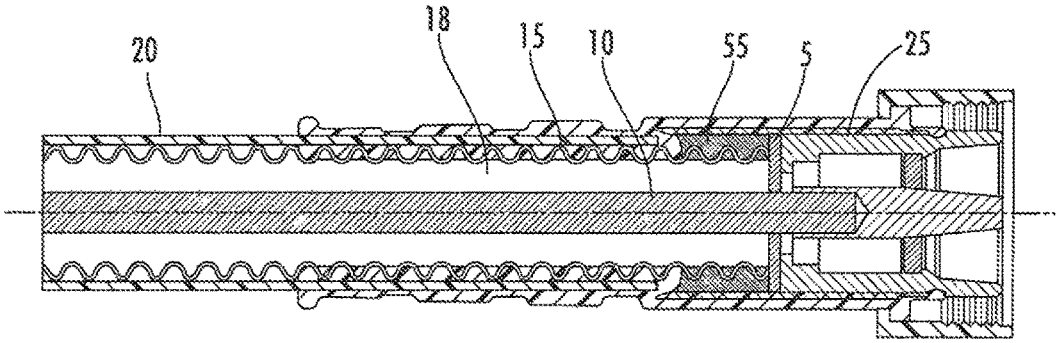
FIG. 1 is a schematic cutaway side view of a conventional cable and connector interconnection utilizing an insulating disc.

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the below description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

It has been recognized that the insulating disc relied upon in prior connector and assembly apparatus to provide the molten solder containment during interconnection (as discussed in the patents noted above) can introduce an impedance discontinuity that may degrade the electrical performance of the resulting interconnection. Analysis of soldered interconnections such as those described in U.S. Pat. No. 5,802,710, supra, and shown in FIG. 1 indicates that, while an insulating disc 5, seated upon the inner conductor 10 of a cable 20 inserted into the bore 55 of a connector 25, is effective at preventing migration of molten solder past the insulating disc 5, solder rosin and/or flux that is liquefied as the pre-assembly is heated for soldering can flow across the insulating disc 5, creating a flux/rosin residue pathway along the insulating disc 5 between the inner and outer conductors 10, 15 of the cable 20. This residue pathway, along with the presence of the higher dielectric constant of the disc dielectric material relative to the foam dielectric material 18 of the coaxial cable 20, lowers the voltage breakdown potential of the coaxial cable 20 and the interconnection of the connector 25 to the cable 20.

Figure 2:
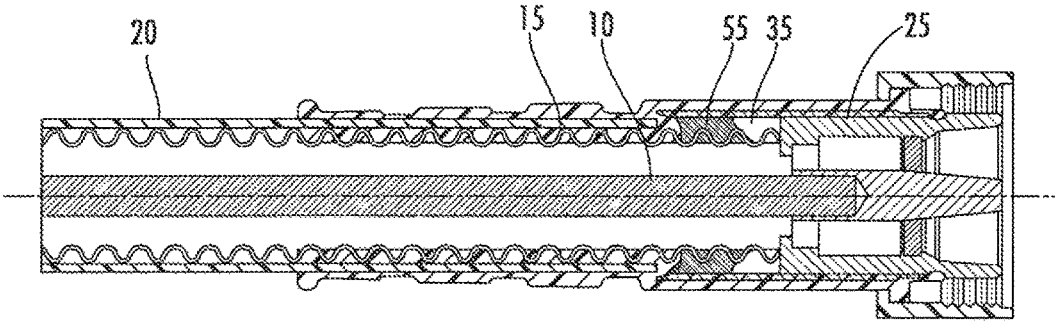
FIG. 2 is a schematic cutaway side view of a conventional cable and connector interconnection with a disc-less configuration and illustrating a gas/air pocket within the solder joint.
Figure 3:
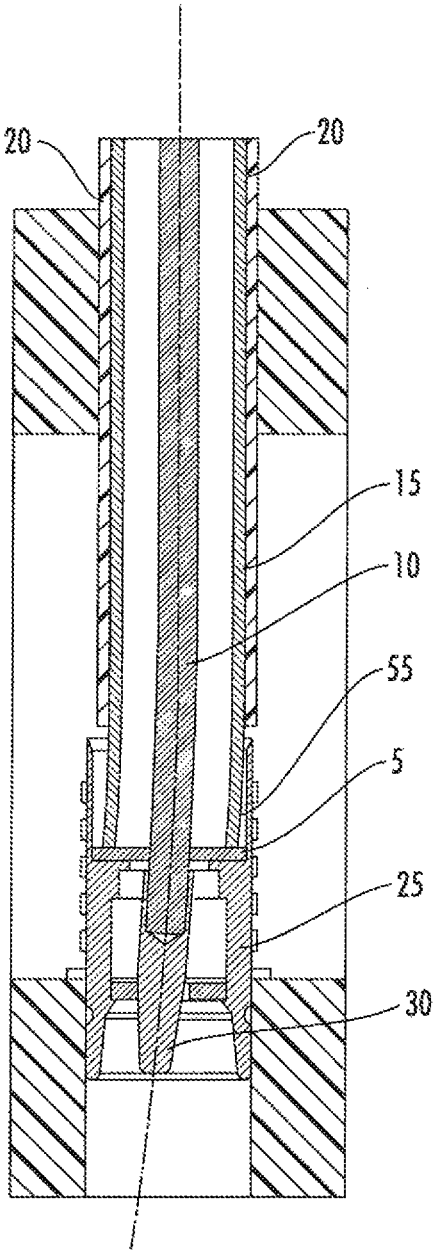
FIG. 3 is a schematic cutaway side view of a conventional cable and connector held in a solder assembly for interconnection utilizing an insulating disc and demonstrating the effect of a non-aligned coaxial cable.
Figure 4:
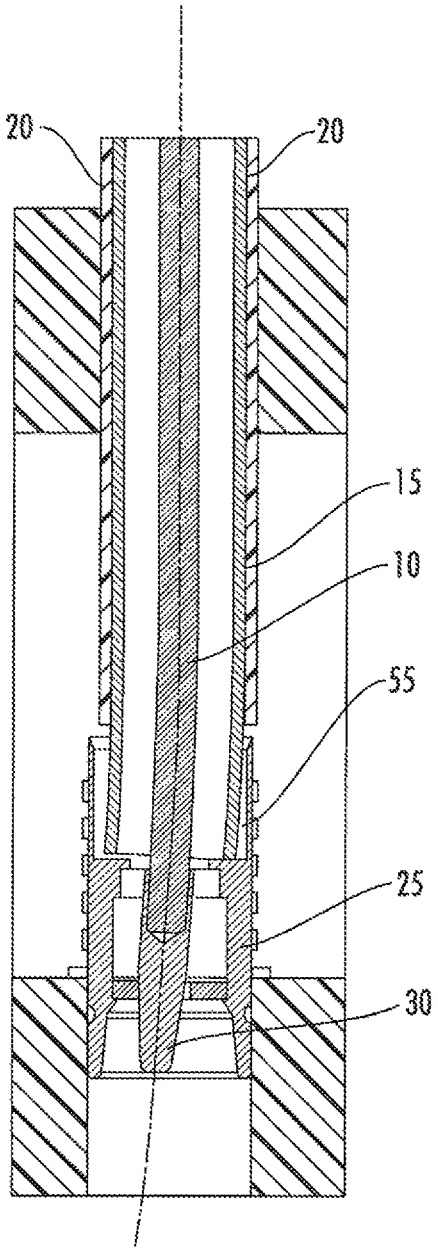
FIG. 4 is a schematic cutaway side view of a conventional cable and connector held in a solder assembly for interconnection in a disc-less configuration and demonstrating the effect of a non-aligned coaxial cable.

Further, inspection of disassembled conventional solder joints has revealed that, although straightening steps may be applied to remove bends present as the bulk coaxial cable is unwound from supply reels, the coaxial cable 20 typically still is not perfectly straight when the interconnection is soldered, as demonstrated in FIGS. 3 and 4. Misalignment between the coaxial cable inner and/or outer diameters may result in (a) a leading edge of the outer conductor 15 that is not squarely seated and/or (b) a skewed inner conductor 10 with a center pin 30 of the connector 25 biased off-center. A partial contact and or contact with an off center bias is believed to be a source of PIM generation, as the metal-to-metal contact changes slightly under the influence of temperature and/or vibration cycling. A particularly severe PIM-generating situation can occur when a solder air/gas pocket 35 remains within the soldered interconnection between the outer conductor 15 and the connector 25 (see FIG. 2). In such an instance, the end of the outer conductor 15 abuts the connector body with a range of movement possible; as examples, corrugations of a corrugated outer conductor 15 may enable a slight accordion-like movement, or a smooth wall outer conductor may slip or slide relative to the conductor body.

Figure 5A:
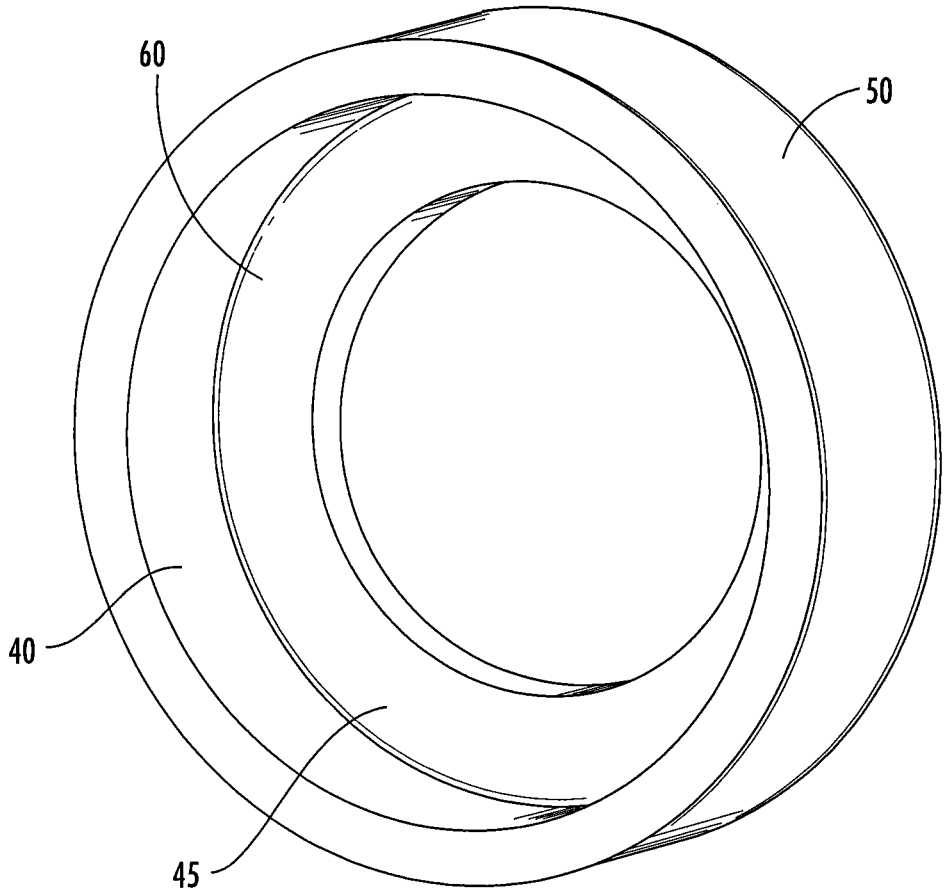
FIG. 5A is a schematic isometric cable end view of an exemplary cable end PIM block according to embodiments of the invention.

A cable end PIM block 50, a replacement for the conventional insulating disk 5 of FIG. 1, is shown in FIG. 5A. The PIM block 50 includes a generally cylindrical flange 40 extending along a longitudinal axis A from an outer periphery of an annular end face 45. The cable end PIM block 50 is dimensioned to seat within an inner diameter of a connector body solder bore 55 (see FIG. 6), with a leading edge of the outer conductor 15 positioned coaxial within a seat 60 formed by an inner diameter of the cylindrical flange 40 and the end face 45. Alternatively, the flange may include a taper for ease of tolerance adaptation with respect to the solder bore 55 or the outer diameter of the outer conductor 15 (see PIM block 50' with flange 40' in FIGS. 5B and 5C), and/or may include slots 52 to provide a self-aligning configuration.

Figure 6:
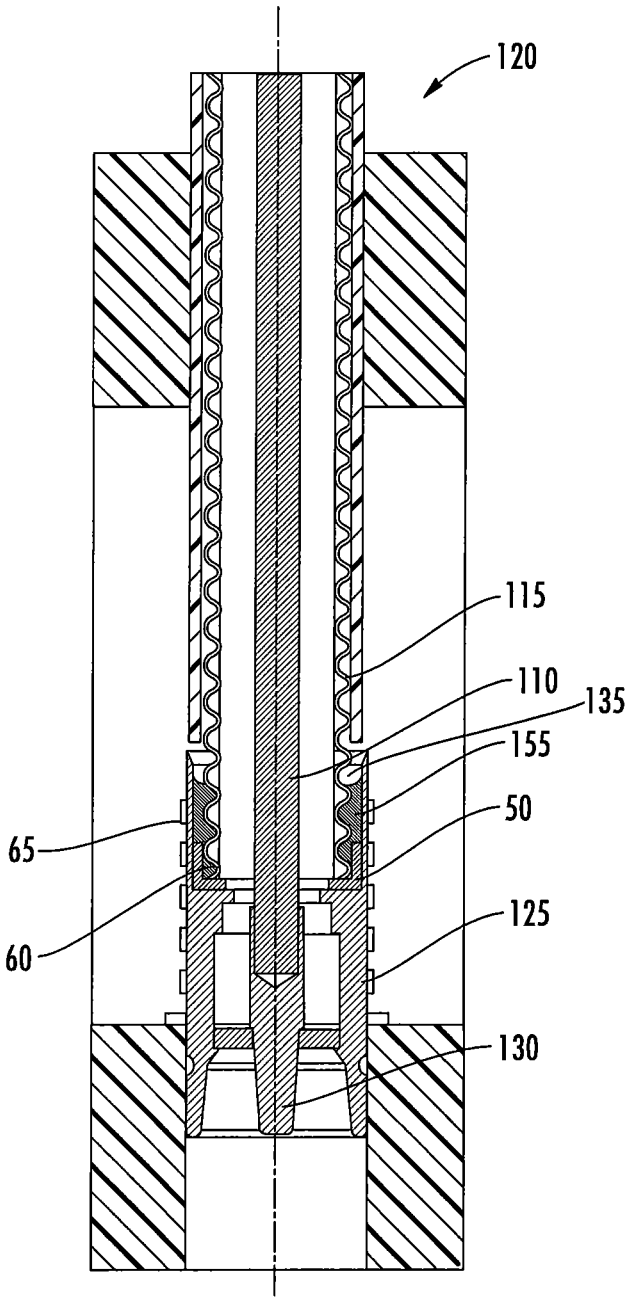
FIG. 6 is a schematic cutaway side view of a cable and connector held in a solder assembly for interconnection utilizing the cable end PIM block illustrated in FIG. 5A, illustrating the cable end PIM block holding the end of the outer conductor coaxial with the solder bore.
Figure 7:
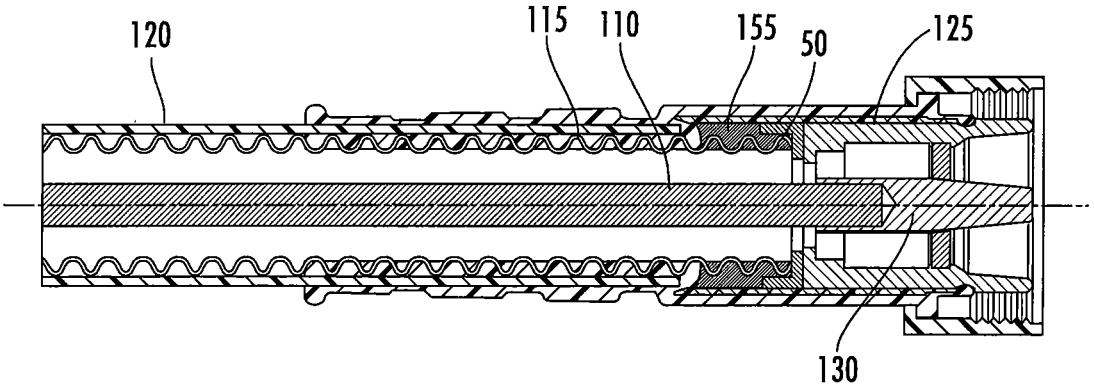
FIG. 7 is a schematic cutaway side view of a cable and connector interconnection utilizing the cable end PIM block of FIG. 5A.

As can be seen in FIGS. 6 and 7, an inner diameter of the end face 45 is dimensioned to be equal to or slightly smaller than an inner diameter of the outer conductor 115 of the cable 110, enabling the end of the outer conductor 115 to seat against the end face 45 to enclose a solder area between the end face 45, the outer diameter of the outer conductor 115 and the inner diameter of the connector body solder bore 155. Because the inner diameter of the end face 45 does not extend into the signal path of the outer conductor (or only minimally extends into the path), any impedance discontinuity due to the presence of the cable end PIM block 50 may be minimized.

Further, as there is not a path between the outer conductor 115 and the inner conductor 110 along the surface of the end face 45, any flow of rosin/flux upon heating for soldering is inhibited from flowing around the inner diameter of the end face 45. As such, there is no residue pathway previously observed with a conventional insulating disc and the attendant lowered voltage breakdown potential of the cable and interconnection.

In addition, use of an end face 45 having a bore size similar to that of the inner diameter of the outer conductor 115 can also maintain the voltage breakdown potential of the cable outer conductor 115 and the inner conductor 110 that the cable was designed for by not having the higher dielectric constant PIM blocks 50, 50' and the dielectric layer (typically foamed) of the cable 110 in contact (as is the case in the prior cable shown in FIG. 1).

The inner diameter of the cylindrical flange 40 is dimensioned to receive the leading edge of the outer conductor 115 in a close fit, and the outer diameter of the cylindrical flange 40 is dimensioned for close fit with the inner diameter of the solder bore 155. Thus, when the leading edge of the outer conductor 115 is seated within the seat 60, the outer conductor 115 is held aligned coaxial with the inner diameter of the solder bore 155 and is entirely insulated from contact with the solder bore 155; in addition, the center pin 130 is aligned and does not create an off-center bias. Thus, the coaxial alignment of the outer conductor 115 with the solder bore 155 can result in a solder joint 65 in which the electro-mechanical interconnection has no stray edges that may cause scraping or migration that may otherwise generate PIM. Further, if a cable end air/gas pocket 135 is present at the end of the outer conductor 115 once soldering is completed, any movement of the end of the outer conductor 115 within the seat 60 will not generate PIM, as no shift in metal-to-metal contact occurs.

Figure 5B:
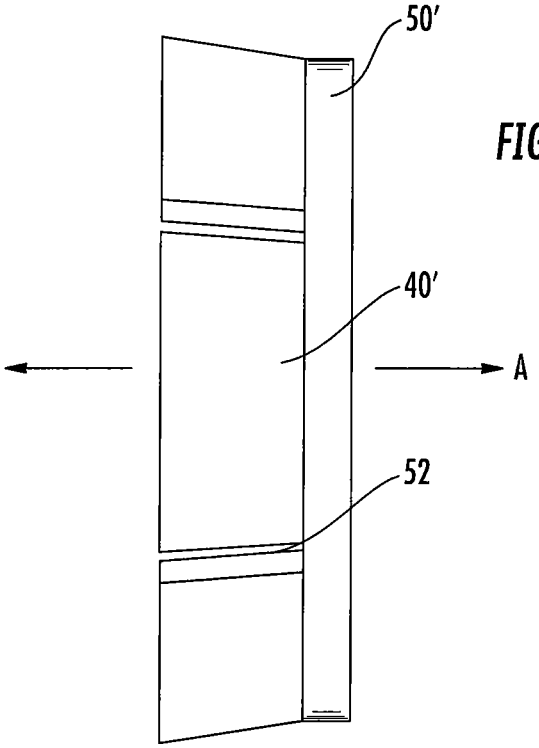
FIG. 5B is a schematic side view of an exemplary cable end PIM block according to additional embodiments of the invention, wherein the PIM block has a taper provided in the generally cylindrical flange and slots for dimensional adaptation and/or self-alignment.
Figure 5C:
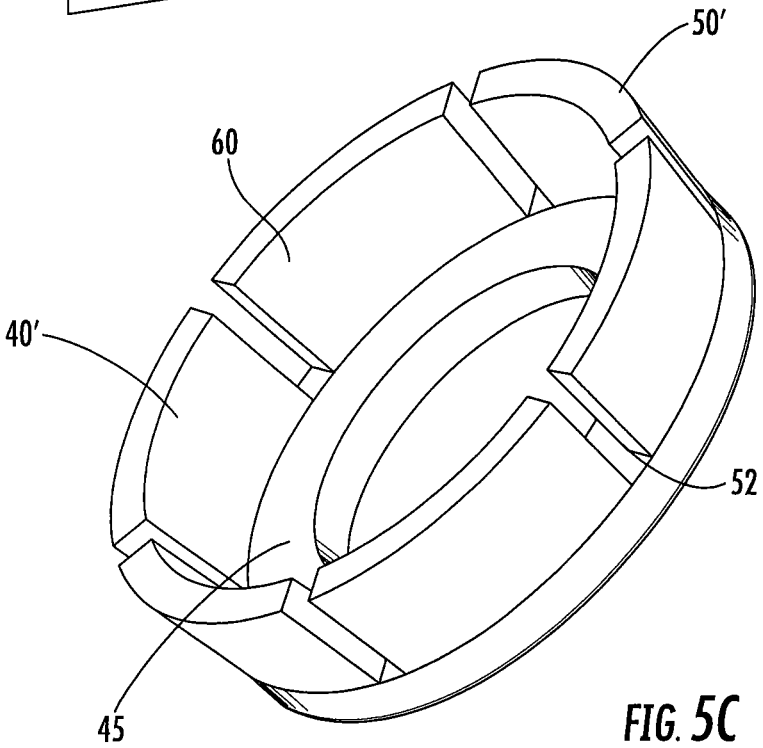
FIG. 5C is a schematic isometric cable end view of the cable end PIM block of FIG. 5B.

The PIM blocks 50, 50' of FIGS. 5A-5C may be formed, for example, by injection molding and/or machining to form a monolithic block of dielectric material. As direct replacements for the prior insulating disc 5, the PIM blocks 50, 50' may be adopted without requiring significant changes to procedures or apparatus.

One skilled in this art will appreciate that the PIM blocks 50, 50' may be utilized with coaxial cables 120 with a wide range of outer conductors 115, such as solid outer conductors, foil outer conductors, and/or woven outer conductors, any of which may have straight or corrugated configurations.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

That which is claimed is:

1. A cable-connector assembly, comprising:

a coaxial connector having an outer connector body with a solder bore;

a coaxial cable having an inner conductor and an outer conductor, the outer conductor seated within the solder bore; and a PIM block comprising an annular seat and a generally cylindrical flange extending from an outer periphery of the annular seat along a longitudinal axis of the annular seat;

wherein a leading edge of the outer conductor of the cable is inserted within the flange of the PIM block; and wherein an outer diameter of the outer conductor is coupled to an inner diameter of the solder bore via a solder joint.

2. The assembly of claim 1, wherein an inner diameter of the annular seat is dimensioned to be equal to or slightly less than an inner diameter of the outer conductor.

3. The assembly of claim 1, wherein the generally cylindrical flange has a tapered sidewall.

4. The assembly of claim 1, wherein the generally cylindrical flange is slotted.

5. The assembly of claim 1, wherein the PIM block is a monolithic portion of dielectric material.

6. The assembly of claim 1, wherein the inner diameter of the annular seat does not contact the inner conductor of the cable.

7. A method for interconnecting a connector and a coaxial cable with an outer conductor; comprising:

providing a coaxial cable having an inner conductor and an outer conductor, the outer conductor having a leading edge;

providing a connector having an outer body with a solder bore;

providing a PIM block having a generally annular seat and a generally cylindrical flange;

seating the leading edge of the outer conductor within the cylindrical flange;

inserting the PIM block and coaxial cable into the solder bore of the connector; and soldering an outer diameter of the outer conductor to an inner diameter of the solder bore.

8. The method of claim 7, wherein an inner diameter of the annular seat is dimensioned to be equal to or slightly less than an inner diameter of the outer conductor.

9. The method of claim 7, wherein the generally cylindrical flange has a tapered sidewall.

10. The method of claim 7, wherein the generally cylindrical flange is slotted.

11. The method of claim 7, wherein the PIM block is a monolithic portion of dielectric material.

12. The method of claim 7, wherein the inner diameter of the annular seat does not contact the inner conductor of the cable.

13. A cable-connector assembly, comprising:

a coaxial connector having an outer connector body with a solder bore;

a coaxial cable having an inner conductor and an outer conductor, the outer conductor seated within the solder bore; and a PIM block comprising an annular seat and a generally cylindrical flange extending from an outer periphery of the annular seat along a longitudinal axis of the annular seat;

wherein a leading edge of the outer conductor of the cable is inserted within the flange of the PIM block and seated against the annular seat.

14. The assembly of claim 1, wherein an inner diameter of the annular seat is dimensioned to be equal to or slightly less than an inner diameter of the outer conductor.

15. The assembly of claim 1, wherein the generally cylindrical flange has a tapered sidewall.

16. The assembly of claim 1, wherein the generally cylindrical flange is slotted.

17. The assembly of claim 1, wherein the PIM block is a monolithic portion of dielectric material.

18. The assembly of claim 1, wherein the inner diameter of the annular seat does not contact the inner conductor of the cable.

* * * * *